US007290508B2

(12) United States Patent
Mizuno et al.

(10) Patent No.: US 7,290,508 B2
(45) Date of Patent: Nov. 6, 2007

(54) LOWER LINK FOR PISTON CRANK MECHANISM OF INTERNAL COMBUSTION ENGINE

(75) Inventors: Hideaki Mizuno, Yokohama (JP); Shunichi Aoyama, Kanagawa (JP); Kenshi Ushijima, Kanagawa (JP); Katsuya Moteki, Tokyo (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 0 days.

(21) Appl. No.: 11/639,216

(22) Filed: Dec. 15, 2006

(65) Prior Publication Data

US 2007/0137608 A1 Jun. 21, 2007

(30) Foreign Application Priority Data

Dec. 20, 2005 (JP) ..... 2005-365704

(51) Int. Cl.
*F02B 75/04* (2006.01)

(52) U.S. Cl. ..... 123/48 B; 123/78 F; 123/197.1

(58) Field of Classification Search ..... 123/197.3, 123/48 B, 197.4, 78 E, 197.1, 78 F
See application file for complete search history.

(56) References Cited

U.S. PATENT DOCUMENTS

| | | | | |
|---|---|---|---|---|
| 6,561,142 | B2 * | 5/2003 | Moteki et al. | 123/48 B |
| 7,121,251 | B2 * | 10/2006 | Moteki et al. | 123/197.1 |
| 2002/0026910 | A1 * | 3/2002 | Hiyoshi et al. | 123/48 B |
| 2002/0144665 | A1 * | 10/2002 | Ushijima et al. | 123/48 B |
| 2004/0112169 | A1 * | 6/2004 | Hiyoshi et al. | 74/579 R |
| 2004/0261733 | A1 * | 12/2004 | Henig et al. | 123/78 E |
| 2005/0005897 | A1 * | 1/2005 | Takahashi et al. | 123/197.4 |
| 2005/0045120 | A1 * | 3/2005 | Moteki et al. | 123/48 B |
| 2005/0061270 | A1 * | 3/2005 | Yamada | 123/78 E |
| 2005/0178353 | A1 * | 8/2005 | Yaguchi et al. | 123/197.3 |
| 2006/0096810 | A1 * | 5/2006 | Eto et al. | 184/6.5 |
| 2007/0044739 | A1 * | 3/2007 | Clarke | 123/78 F |
| 2007/0044740 | A1 * | 3/2007 | Watanabe et al. | 123/78 F |

FOREIGN PATENT DOCUMENTS

| | | | |
|---|---|---|---|
| EP | 1 180 588 | A2 | 2/2002 |
| EP | 1 247 960 | A2 | 10/2002 |
| EP | 1 359 303 | A2 | 11/2003 |
| EP | 1 496 218 | A2 | 1/2005 |
| JP | 2002 195001 | A | 7/2002 |
| JP | 2004-124776 | A | 4/2004 |
| JP | 2004124776 | A * | 4/2004 |

* cited by examiner

*Primary Examiner*—Noah P. Kamen
(74) *Attorney, Agent, or Firm*—Foley & Lardner LLP

(57) ABSTRACT

A lower link for a piston crank mechanism of an internal combustion engine includes an upper section, a lower section, and a crank pin bearing section disposed between the upper section and the lower section, and mounted on a crank pin of a crank shaft. One of the upper section and the lower section is formed with a bolt inserting hole. The other of the upper section and the lower section is formed with an internal thread portion including an open end. One of the bolts passes through the bolt inserting hole, is screwed into the internal thread portion, and includes an end bared from the open end which is formed in a surface perpendicular to a bolt center axis. The other of the upper section and the lower section includes a recessed portion formed in the surface to divert a stress transmitting path.

17 Claims, 10 Drawing Sheets

LOWER LINK FOR PISTON CRANK MECHANISM OF INTERNAL COMBUSTION ENGINE

BACKGROUND OF THE INVENTION

The present invention relates to a piston crank mechanism for a reciprocating type internal combustion engine, and more specifically to a link for a multi-link type piston crank mechanism.

Japanese Patent Application Publication No. 2004-124776 which the applicant filed shows a multi-link type piston crank mechanism for a reciprocating type internal combustion engine which connects a piston pin and a crank pin. This multi-link type piston crank mechanism includes an upper link connected with the piston pin of a piston, a lower link connecting the upper link and the crank pin of a crank shaft, and a control link having a first end pivotally supported by a body of an engine, and a second end connected with the lower link. The upper link and the lower link are rotatably connected with each other through the upper pin. The control link and the lower link are rotatably connected with each other through a control pin.

In this multi-link type piston crank mechanism, the lower link receives a combustion pressure received by the piston, from the upper pin through the upper link. The lower link is actuated like a lever so as to transmit force to the crank pin. Accordingly, it is necessary that the lower link has strength and rigidity to rotatably support the upper pin, the control pin and the crank pin, and to hold relative positions of the upper pin, the control pin and the crank pin, even when the lower link receives the input from the upper pin, the control pin and the crank pin.

On the other hand, it is necessary to ensure facility of assembly operation of the lower link to the crank shaft. In the above-mentioned Patent Application Publication, the lower link has a two part structure divided into two parts (a lower link upper section and a lower link lower section) along a dividing surface which passes through a center of a crank pin bearing section. The lower link upper section and the lower link lower section are tightened with each other by a plurality of bolts. For example, the plurality of the bolts are inserted from the below (that is, from the lower link lower section's side), and screwed into an internal thread in the lower link upper section.

SUMMARY OF THE INVENTION

The lower link is a member receiving a large load, and stress is concentrated at the internal thread of the lower link. Accordingly, it is not desirable that the internal thread is formed in the lower link because the stress is concentrated to the internal thread.

In a reference view of FIG. 9, arrows F1, F2 and F3 show directions of forces which the lower link receives, at the engine combustion, from the crank pin, the upper pin and the control pin respectively. Since the lower link receives the large loads F1, F2 and F3 which are inputted from the three pins, and which are directed in the opposite directions, large stress is caused in the lower link itself. Accordingly, it is necessary that bolts 103 and 105 are applied with enough axial force in advance, so as not to separate lower link upper section 101 and lower link lower section 102 at a dividing surface 107. Therefore, the bolt axial force and also the stress for the load of the lower link itself are concentrated to internal thread portions 104 and 106 into which bolts 103 and 105 are screwed. The forces acting on both sides of each of bolts 103 and 105 are applied in the opposite directions, and accordingly internal thread portions 104 and 106 are applied with the stress and also large moments. Accordingly, it is requested to ensure durability of the lower link around the internal thread portion.

FIG. 10 is a schematic sectional view showing a portion around an open end of internal thread portion 104 into which an end of bolt 103 on the control pin's side is screwed. When loads F2 and F3 are applied to sandwich the crank pin as mentioned above, the stress is transmitted along stress transmitting paths shown by numeral 108, between internal thread portion 104 and the upper pin. Consequently, the stress is concentrated at internal thread portion 104 near the end of bolt 103, especially at roots of the internal thread portion 104.

Moreover, in a case in which the entire lower link is case-hardened (face-hardened) with carburizing and so on, the end of the bolt is engaged with a boundary between the case-hardened layer and a base metal. Accordingly, the durability tends to be deteriorated from the boundary surface by fatigue.

It is an object of the present invention to provide a lower link for a piston crank mechanism of an internal combustion engine which aimed to solve the above mentioned problem, and arranged to suppress a concentration of stress to an internal thread portion of the lower link, and to improve durability and reliability of the internal thread portion.

According to one aspect of the present invention, a lower link for a piston crank mechanism of an internal combustion engine, the piston crank mechanism including an upper link having a first end connected through a piston pin with a piston, and a second end connected through an upper pin to the lower link, and a control link having a first end swingably supported by the engine, and a second end connected through a control pin to the lower link, the lower link comprises: an upper section including an upper pin boss portion arranged to hold the upper pin; a lower section including a control pin boss portion arranged to hold the control pin; and a crank pin bearing section disposed between the upper section and the lower section, and mounted on a crank pin of a crank shaft; the upper section and the lower section being coupled by at least two bolts disposed to sandwich the crank pin bearing section, one of the upper section and the lower section being formed with a bolt inserting hole, the other of the upper section and the lower section being formed with an internal thread portion including an open end, one of the bolts passing through the bolt inserting hole of the one of the upper section and the lower section, being screwed into the internal thread portion of the other of the upper section and the lower section, and including an end bared from the open end of the internal thread portion which is formed in a surface perpendicular to a bolt center axis, and the other of the upper section and the lower section including a recessed portion formed in the surface to divert a stress transmitting path.

DETAILED DESCRIPTION OF THE INVENTION

Hereinafter, embodiments of the present invention will be illustrated by using FIGS. 1~8. Firstly, a piston crank mechanism which can employ a lower link according to the embodiments of the present invention will be illustrated.

Figure 1:
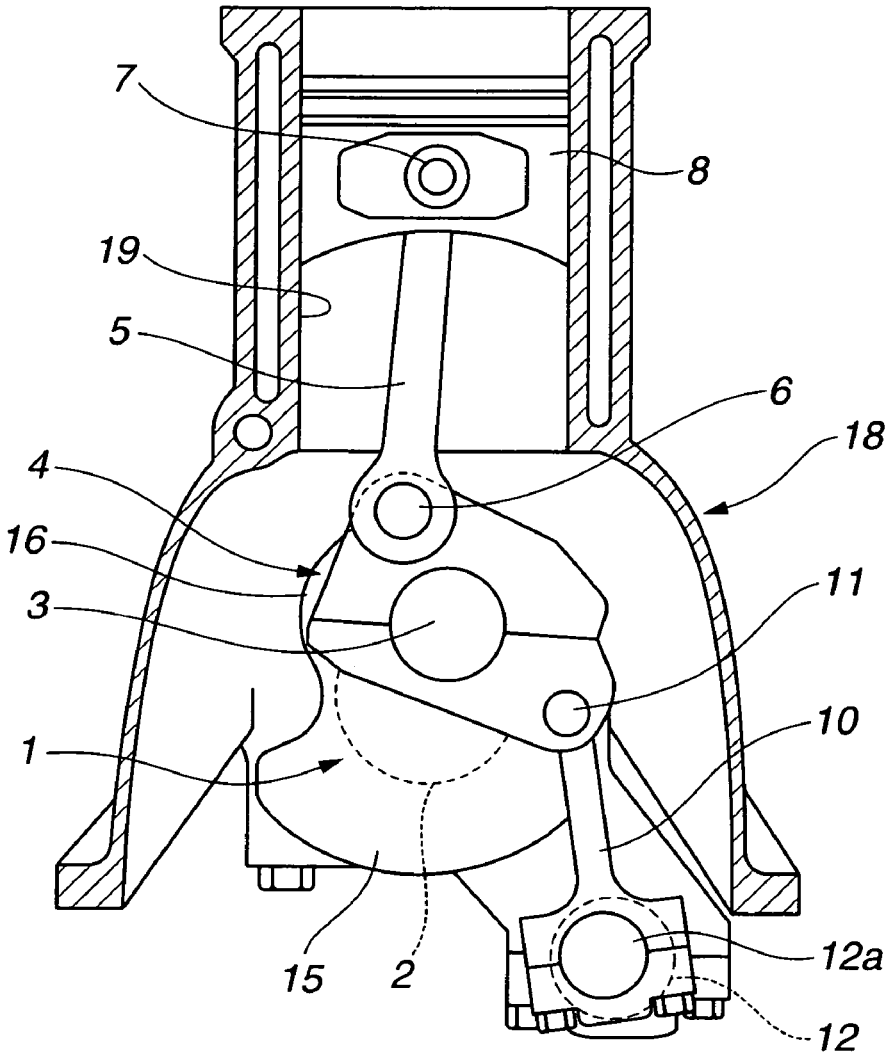
FIG. 1 is a view showing a piston crank mechanism which can employ a lower link according to the present invention.

FIG. 1 is a view showing a multi-link type piston crank mechanism constituting a variable compression ratio mechanism. The multi-link type piston crank mechanism includes a main part having a lower link 4, an upper link 5, and a control link 10.

A crank shaft 1 is provided with a plurality of journal portions 2 and a crank pin 3. Each of journal portions 2 is rotatably supported on a main bearing of a cylinder block 18. Crank pin 3 has a center which is off an center axis of journal portions 2 by a predetermined distance. Lower link 4 is rotatably connected with crank pin 3. A counterweight 15 extends from a crank web 16 connecting journal portions 2 and crank pin 3, in a direction opposite to crank pin 3.

Lower link 4 has a two part structure including two members as described later. Lower link 4 includes a crank pin bearing portion located at a substantially central position of lower link 4, and mounted on crank pin 3.

Upper link 5 has a lower end portion rotatably connected to a first end portion of lower link 4 by an upper pin 6, and an upper end portion rotatably connected to a piston 8 by a piston pin 7. Piston 8 receives a combustion pressure, and reciprocates within a cylinder 19 of a cylinder block 18.

Control link 10 restricts a movement of lower link 4. Control link 10 has an upper end portion rotatably connected to a second end portion of lower link 4 by a control pin 11, and a lower end portion rotatably connected to a lower part of cylinder block 18 forming part of the engine. That is, control shaft 12 is rotatably supported by the main body of the engine. Control shaft 12 includes an eccentric cam portion 12*a* whose center is off a center axis of control shaft 12. A lower part of control link 10 is rotatably mounted on eccentric cam 12*a*.

A compression ratio control actuator (not shown) controls a rotation position of control shaft 12 in response to a control signal from an engine control unit (not shown).

In the above-described variable compression ratio mechanism using the multi-link type piston crank mechanism, when control shaft 12 is rotated by the compression ratio control actuator, a center position of eccentric cam portion 12*a* is varied with respect to the main body of the engine. Thereby, a pivot support position of the lower part of control link 10 is varied. Subsequently, a stroke of piston 8 is varied, and a position of piston 8 at a top dead center (TDC) is moved up and down to vary the engine compression ratio.

Figure 2:
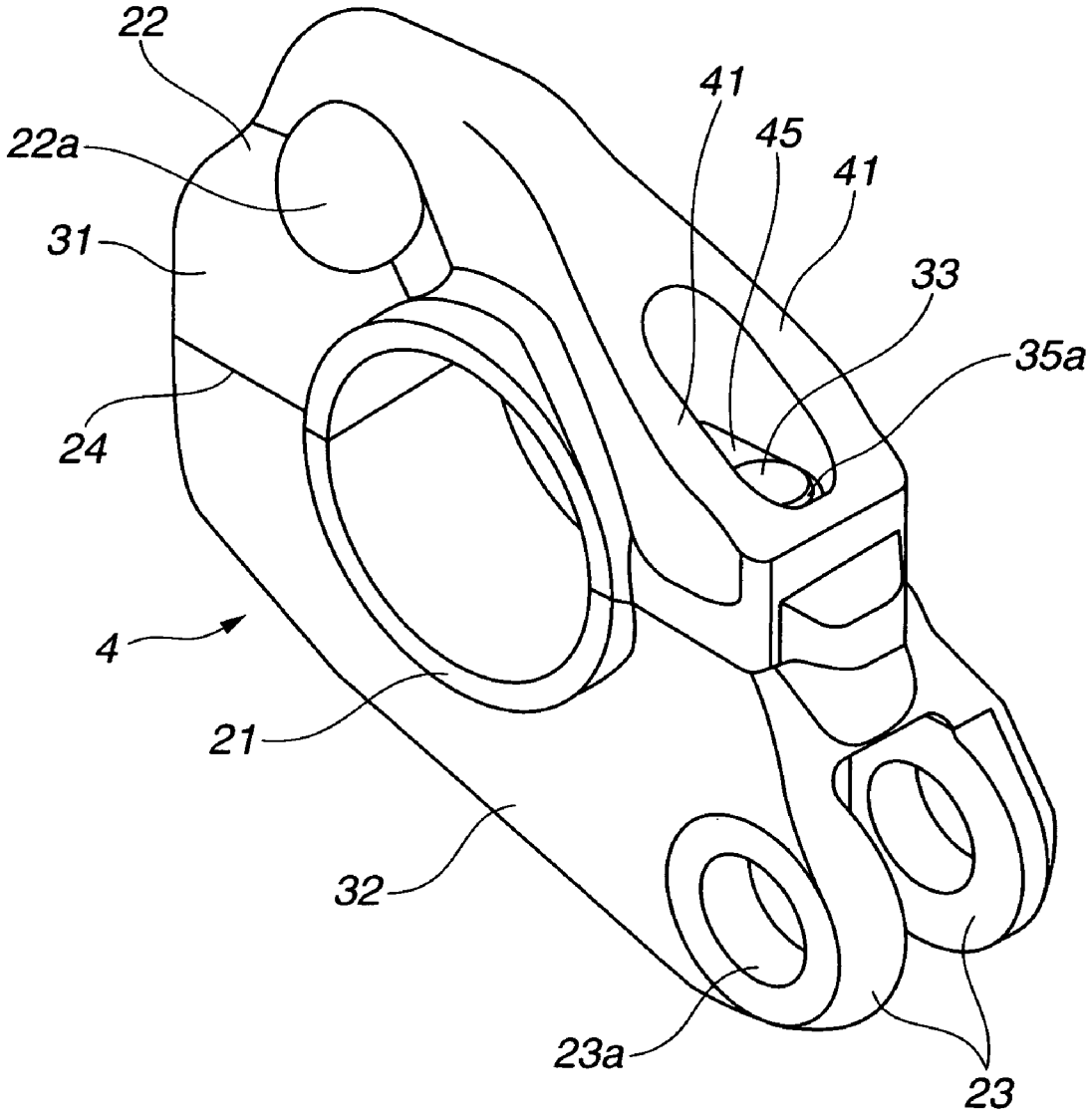
FIG. 2 is a perspective view showing a lower link according to a first embodiment of the present invention.
Figure 3:
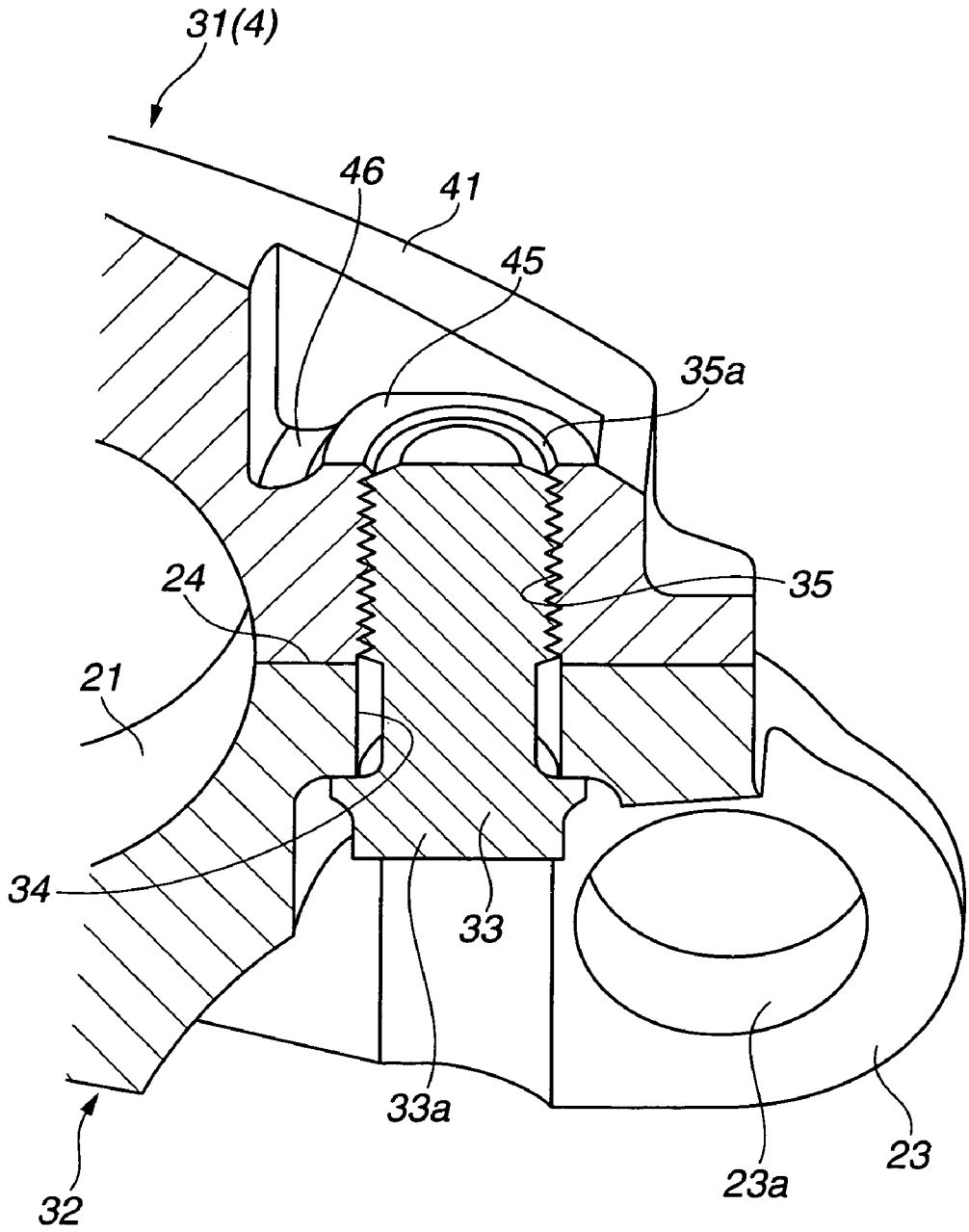
FIG. 3 is a sectional perspective view showing the lower link of FIG. 2.

FIG. 2 shows a lower link 4 which can employ the present invention. FIG. 3 is a sectional perspective view of lower link 4 of FIG. 2. Next, lower link 4 according to the first embodiment of the present invention will be illustrated with reference to FIGS. 2 and 3.

Lower link 4 includes a crank pin bearing portion (crank pin bearing section) 21 located at a substantially central position of lower link 4, and mounted on crank pin 3; an upper pin boss portion 22 located at one end portion of lower link 4, and arranged to hold upper pin 6; and a control pin boss portion 23 located at the other end of lower link 4, and arranged to hold control pin 11. To facilitate the assembly operation to crank pin 3, lower link 4 is divided into a lower link upper section 31 and a lower link lower section 32, along a dividing surface which passes through a center of crank pin bearing portion 21. Lower link upper section 31 includes upper pin boss portion 22. Lower link lower section 32 includes control pin boss portion 23. Lower link upper section 31 and lower link lower section 32 are integrally tightened by two bolts 33 which are disposed on both sides of crank pin bearing portion 21 (on the upper pin boss portion 22's side and on the control pin boss portion 23's side), respectively (one bolt 33 is not shown). If cylinder 19 is disposed in an up-down direction, lower link upper section 31 is positioned on an upper side in a crank case, and lower link lower section 32 is positioned on a lower side in the crank case. Each bolt 33 is inserted upward from a lower surface of lower link lower section 32.

Upper pin 6 is rotatably supported in a pin hole 22*a* of upper pin boss portion 22. Upper link 5 includes a lower portion formed with an upper pin bearing, and shaped like a bifurcated shape. Upper pin boss portion 22 of lower link 4 is rotatably assembled to the inside of the bifurcated lower portion of upper link 5.

On the other hand, control pin 11 is rotatably supported in a pin hole 23*a* of control pin boss portion 23. Control pin boss portion 23 is shaped like a bifurcated shape (two-forked shape), a pin boss portion of one end of control link 10 is rotatably assembled to an inside of the bifurcated control pin boss portion 23.

The one bolt 33 (not shown) of the two bolts 33 is located on the upper pin boss portion 22's side, and passes through a bolt insertion hole of lower link lower section 32. An end portion of the one bolt 33 is screwed to an internal thread portion of lower link upper section 31. Upper pin boss portion 22 is located on an extension of the center line of the one bolt 33. Therefore, a screw hole of the internal thread portion does not penetrate through lower link upper section 31 in the axial direction of the bolt, and is sealed at an end portion. Accordingly, this one bolt 33 can not be shown in FIG. 2.

On the other hand, the other bolt 33 of bolts 33 is located on the control pin boss portion 23's side. This bolt 33 includes a bolt head 33*a* located at a bottom portion of control pin boss portion 23 formed into the bifurcated shape (two-forked shape as shown in FIG. 3), and an end portion screwed into an internal thread portion 35 of the lower link upper section 31 (shown in FIG. 3). Internal thread portion 35 for this bolt 33 penetrates through lower link upper section 31 in the up-down direction of FIG. 3 (in the axial direction of the bolt), and an end of this bolt 33 is exposed (bared) from an upper surface of lower link upper section 31.

As shown in FIG. 3, an upper end opening (open end) 35*a* of internal thread portion 35 is located at the upper surface of lower link upper section 31. A pair of ribs 41 are formed so as to sandwich-upper end opening 35*a*, and extend along a plane perpendicular to a crank pin center line. That is, ribs 41 are formed so as to elongate both end surface portions of lower link 4 in the upward direction to sandwich opening 35*a*, and are connected obliquely to the upper end portion of upper pin boss portion 22. That is, the upper end portion of upper pin boss portion 22 extends to control pin boss portion 23, and is bifurcated to form the pair of ribs 41.

A bottom (gap) between the pair of ribs 41 is a surface 45 perpendicular to the bolt center line. Upper end opening 35*a* is opened in surface 45. Besides, the end of bolt 33 does not protrude from upper end opening 35*a*, and is flush with surface 45 in the axial direction of bolt 35.

As show in FIG. 3, a recessed portion 46 is formed in an end portion of surface 45 adjacent to upper end opening 35*a*, between crank pin bearing portion 21 and upper end opening 35*a*. Recessed portion 46 is in the form of a groove which extends in the axial direction of the crank pin. This recessed portion 46 extends from an inner wall surface of one of ribs 41, to an inner wall surface of the other of ribs 41. FIG. 3 shows the sectional view taken along the plane which is perpendicular to the central axis of the crank pin, and which passes through the central axis of bolt 33. In this section as shown in FIG. 3, recessed portion 46 has a substantially U-shaped section having a radius of corner (radius of curvature) on the bolt 33's side which is larger than a radius of corner (radius of curvature) on the crank pin's side. Moreover, a depth of recessed portion 46 in the axial direction of bolt 33 is larger than a pitch of the screw of internal thread portion 35. Besides, this depth of recessed portion 46 is larger than a depth of a border between a base metal and a case-hardened layer treated by carburizing and so on.

Figure 4:
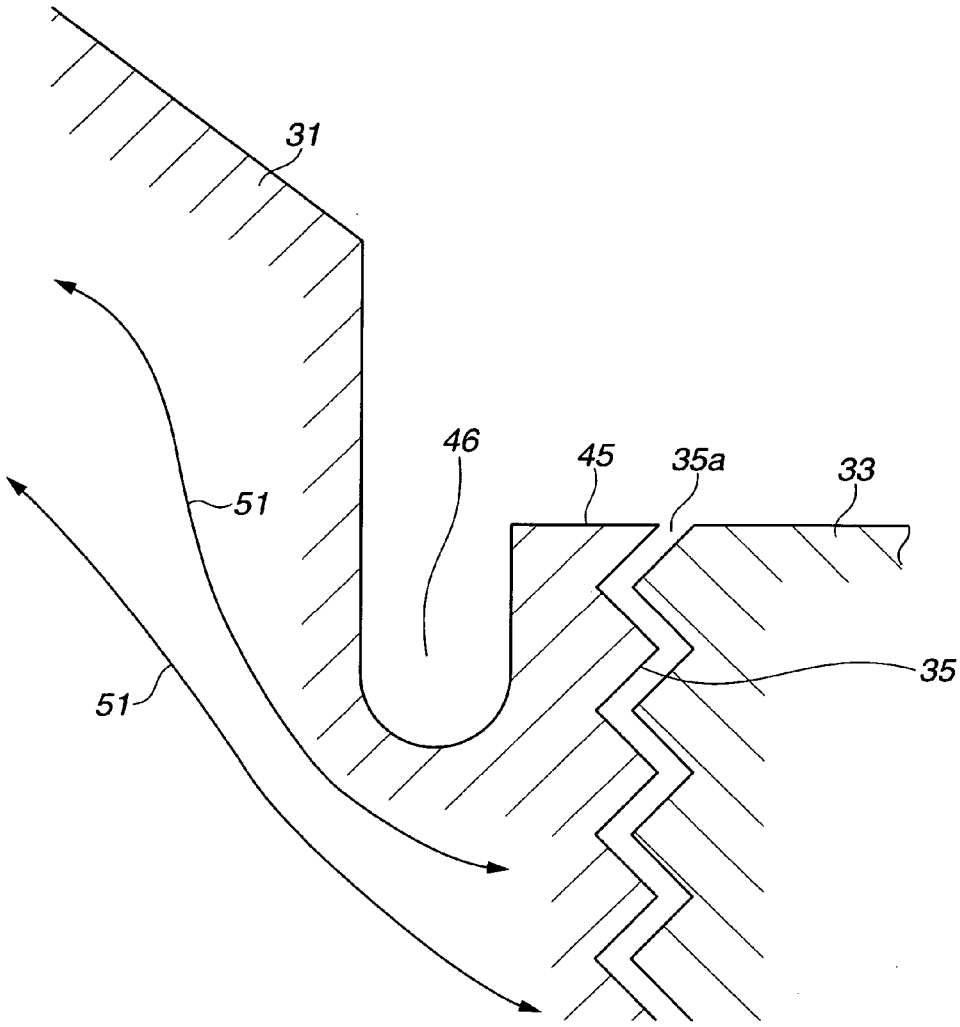
FIG. 4 is a view showing a stress transmitting path in the lower link of FIG. 2.

FIG. 4 shows a flow of stress (stress when lower link 4 receives the loads from crank pin 3, upper pin 6, and control pin 11, as described above) in a case in which recessed portion 46 is formed adjacent to upper opening 35*a* of internal thread portion 35 as described above. As shown by arrows 51 of FIG. 4, a stress transmitting path (stress) passes outside recessed portion 46, so that the stress becomes small at a portion of internal thread portion 35 near upper end opening 35*a* with which the end of bolt 33 is engaged. The concentration of the stress is decreased at roots near upper opening 35*a*. Moreover, recessed portion 46 is formed so that the depth of recessed portion 46 is greater than the depth of the border between the base metal and the surface-hardened layer treated by the carburizing. Accordingly, it is possible to prevent the border which tends to become a starting point (source) of fatigue breaking, from overlapping with the stress concentrating portion at which the stress is concentrated, and thereby to improve durability and reliability of internal thread portion 35.

Besides, the stress is concentrated to a cutaway portion of recessed portion 46. However, the radius of the corner of the bottom portion of recessed portion 46 is sufficiently increased, and the radius of the corner on the bolt 33's side is larger than the radius of the corner on the crank pin's side. Thereby, it is possible to suppress influence on internal thread portion 35 since the stress concentration of the corner of recessed portion 46 is away from internal thread portion 35.

Figure 5:
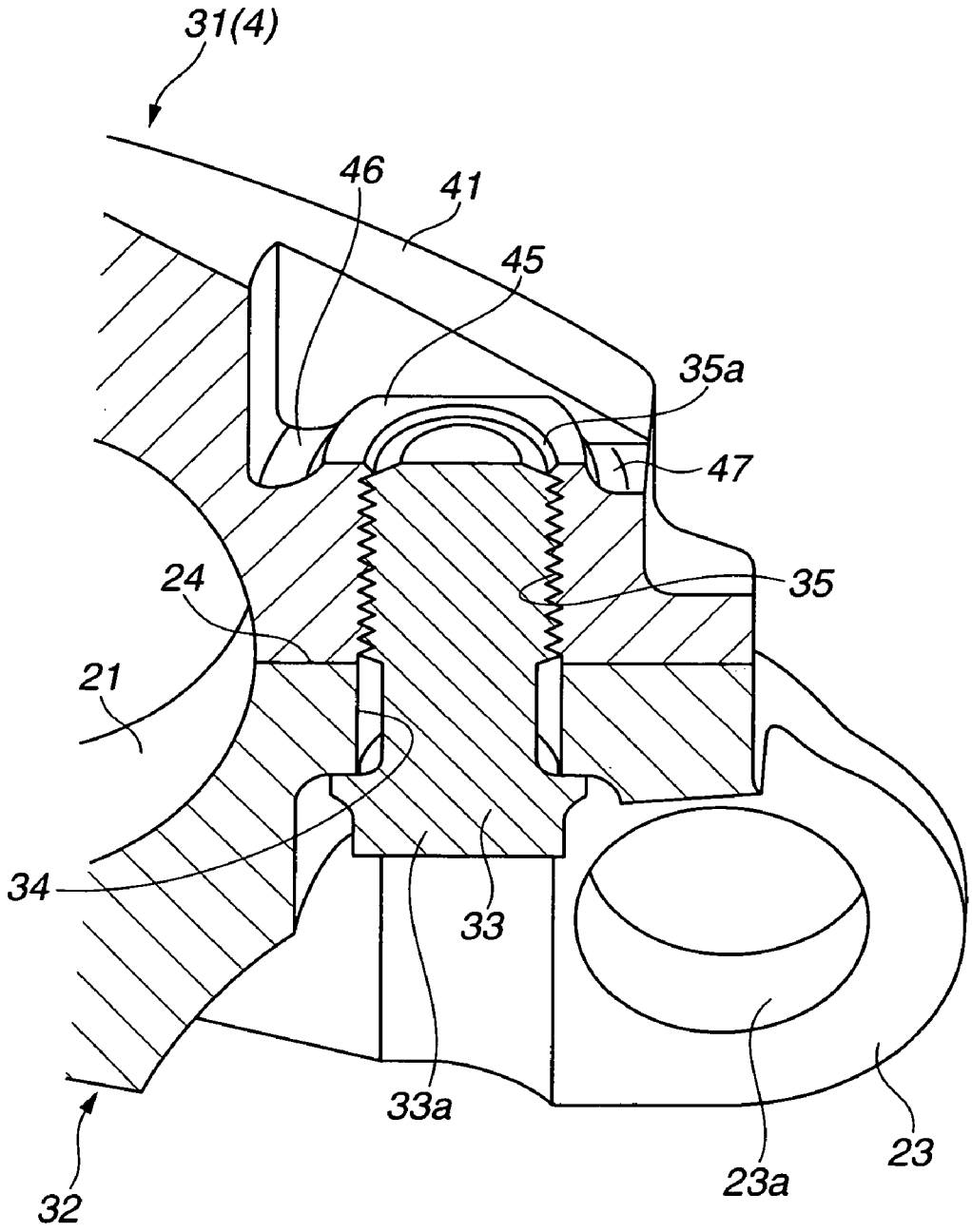
FIG. 5 is a sectional perspective view showing a lower link according to a second embodiment of the present invention.

Next, FIG. 5 shows a lower link according a second embodiment, and including a second recessed portion 47 which is formed at the end portion of surface 45 on an opposite side to recessed portion 46 (on the right side in FIG. 5), in addition to recessed portion 46. In this lower link 4, recessed portion 46 is located on one side of upper open end 35*a* (on the left side as shown in FIG. 5), and second recessed portion 47 is located on the other side of upper open end 35*a* (on the right side as shown in FIG. 5). Second recessed portion 47 is identical in a sectional shape to recessed portion 46. Moreover, second recessed portion 47 extends from an inner wall surface of one of ribs 41 to an inner wall surface of the other of ribs 41. In particular, second recessed portion 47 is located at a position corresponding to end portions of ribs 41 at which ribs 41 start to extend from surface 45.

That is, ribs 41 receive load of compression and tension by load input from upper pin boss portion 22, and the stress is concentrated at the vicinity of the end portions of ribs 41. However, second recessed portion 47 suppresses the transmission of the stress to upper opening of 35*a* of internal thread portion 35.

Figure 6:
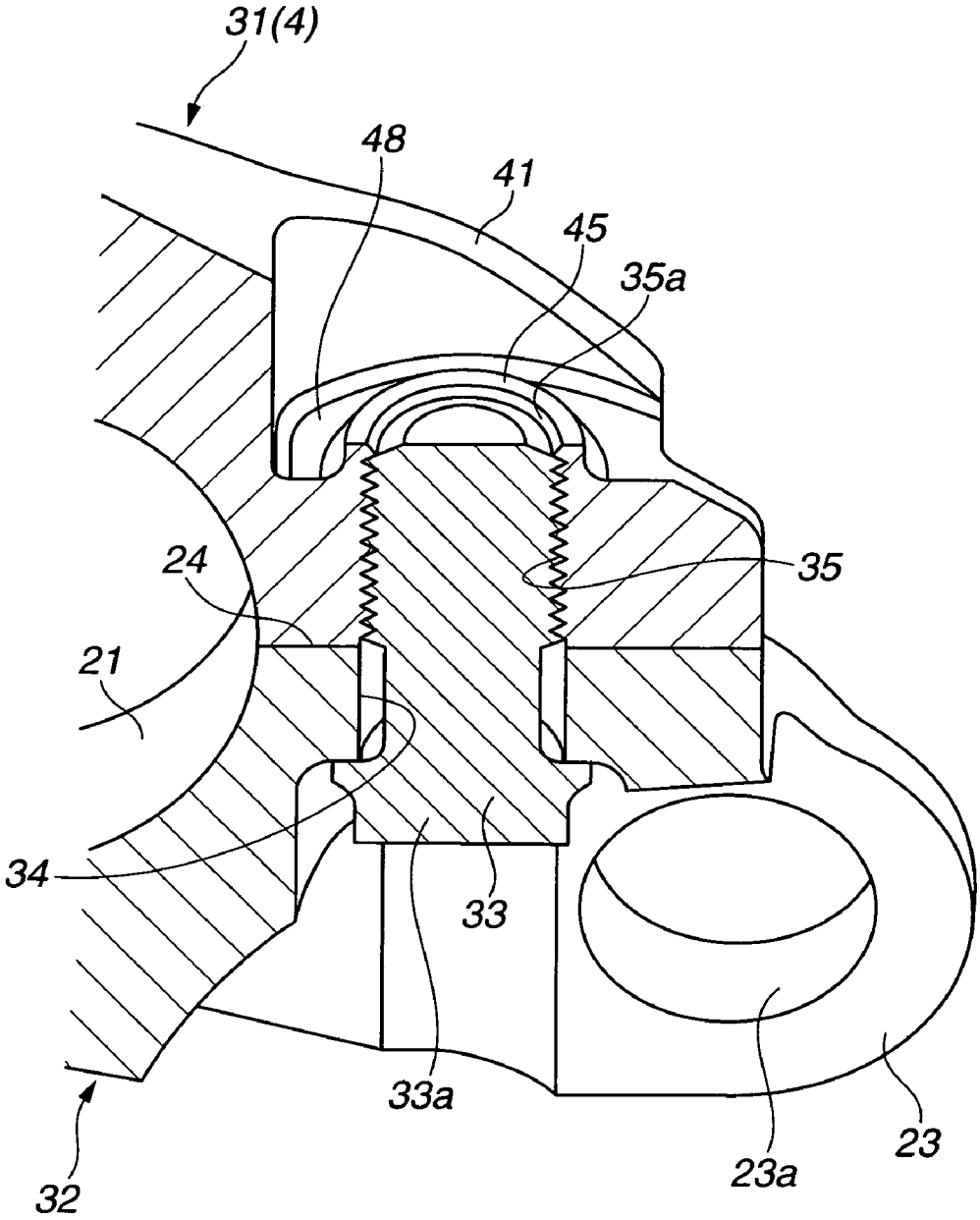
FIG. 6 is a sectional perspective view showing a lower link according to a third embodiment of the present invention.

FIG. 6 shows a lower link according to a third embodiment of the present invention, and including a recessed portion 48 continuously extending over (around) all circumferences of upper end opening 35*a* of internal thread portion 35. In this structure, recessed portion 48 is provided in a radial direction of the crank pin (between upper end opening 35*a* and each of ribs 41), around upper end opening 35*a*. Accordingly, it is possible to decrease the input from ribs 41. This structure is preferable to a case in which the axial length (size) of lower link 4 in the axial direction of the crank pin is ensured to an extent, relative to the illustrated embodiments as described above.

Figure 7:
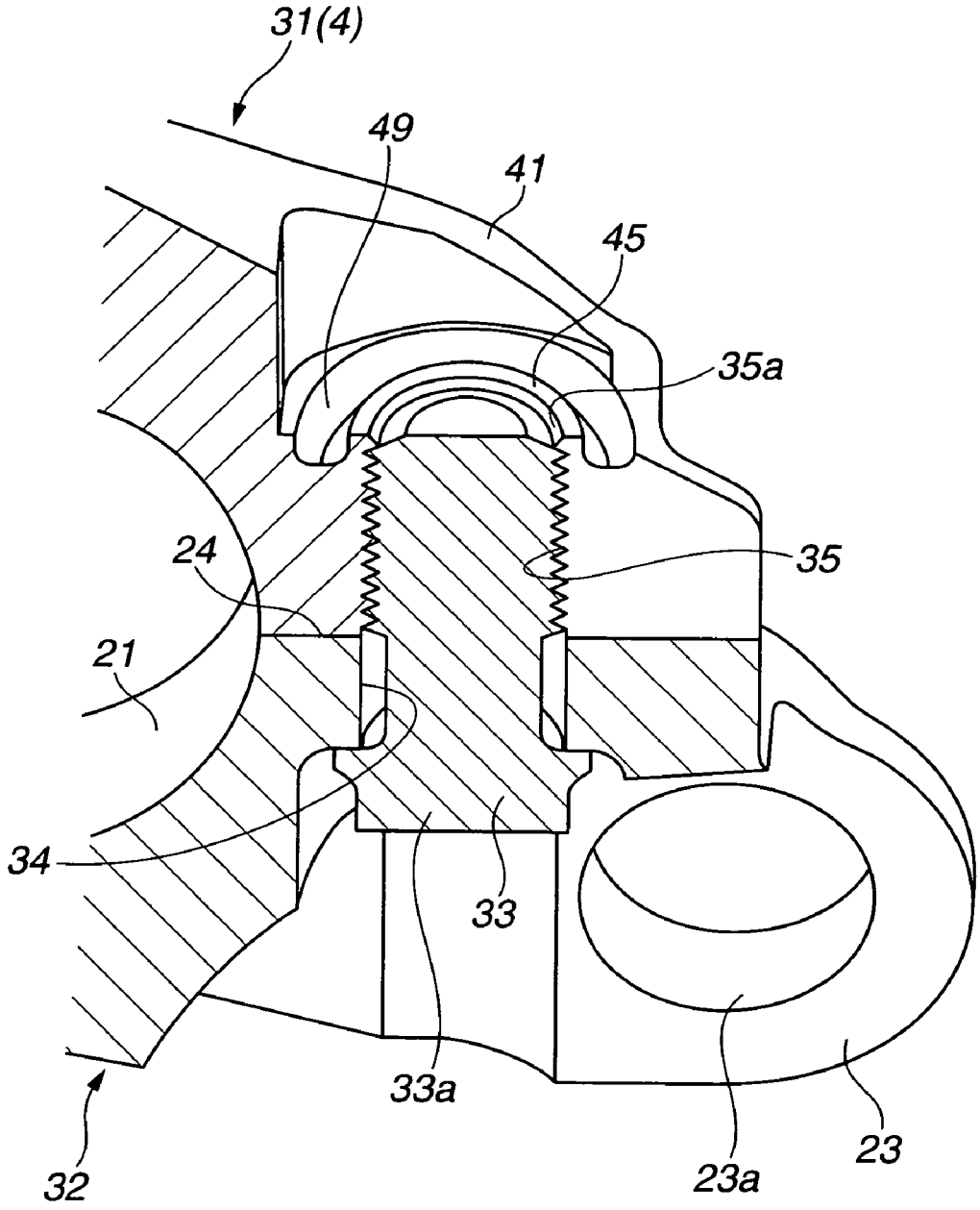
FIG. 7 is a sectional perspective view showing a lower link according to a fourth embodiment of the present invention.

FIG. 7 shows a lower link according to a fourth embodiment of the present invention, and including a recessed portion 49 continuously extending over (around) all circumferences of upper end opening 35*a* of internal thread portion 35, like the lower link of the third embodiment of FIG. 6. In particular, in a section which passes through the center axis of bolt 33, and which extends along a plane perpendicular to the center axis of the crank pin, recessed portion 49 has a U-shaped section including two parallel lines which extend along each other, and an arc (semicircle) having a diameter of distance between the two lines. Besides, this U-shaped recessed portion 49 is recessed in a direction perpendicular to surface 45. This U-shaped recessed portion 49 is readily manufactured by tools having a cylindrical shape.

Figure 8:
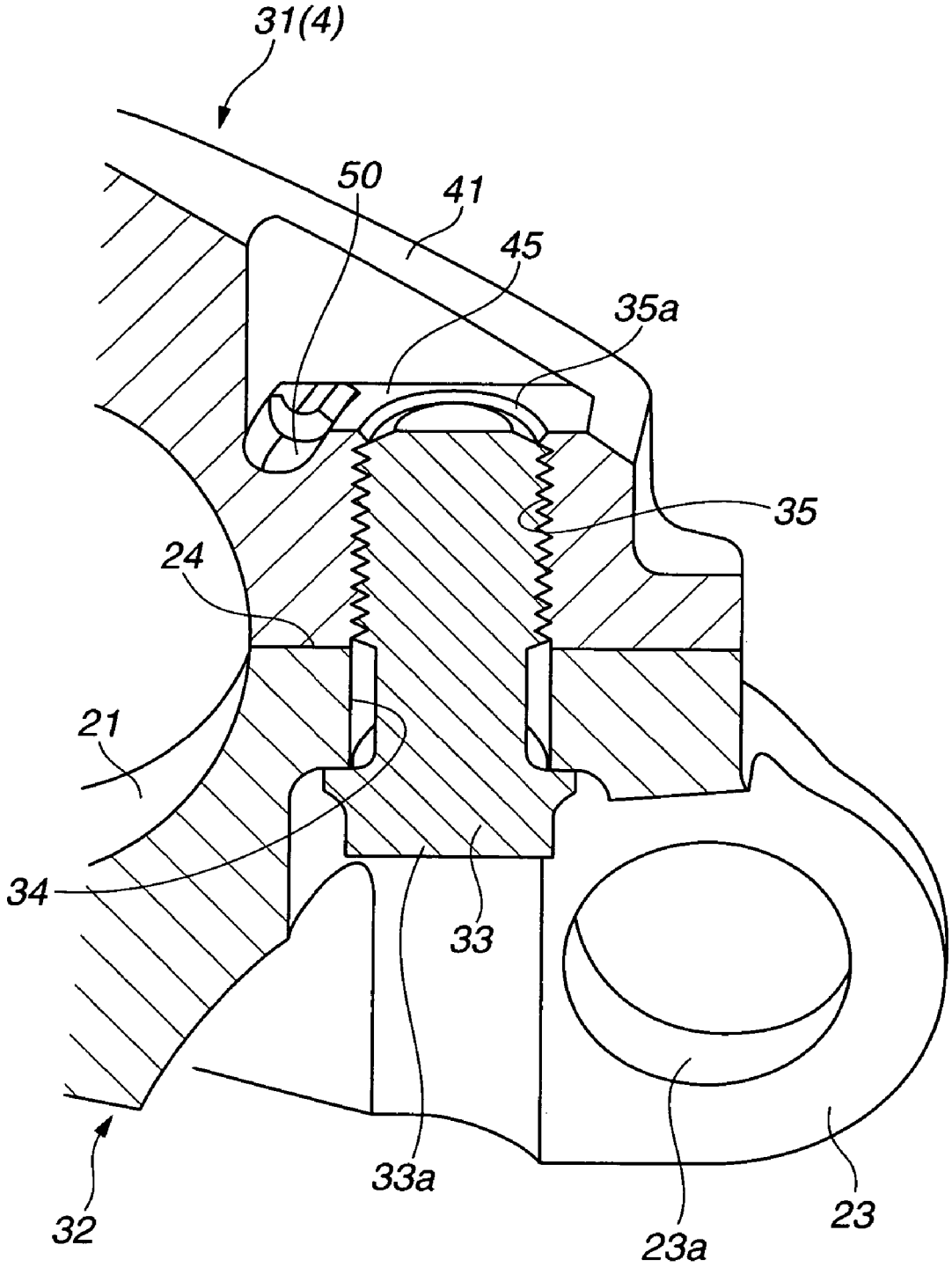
FIG. 8 is a sectional perspective view showing a lower link according to a fifth embodiment of the present invention.
Figure 9:
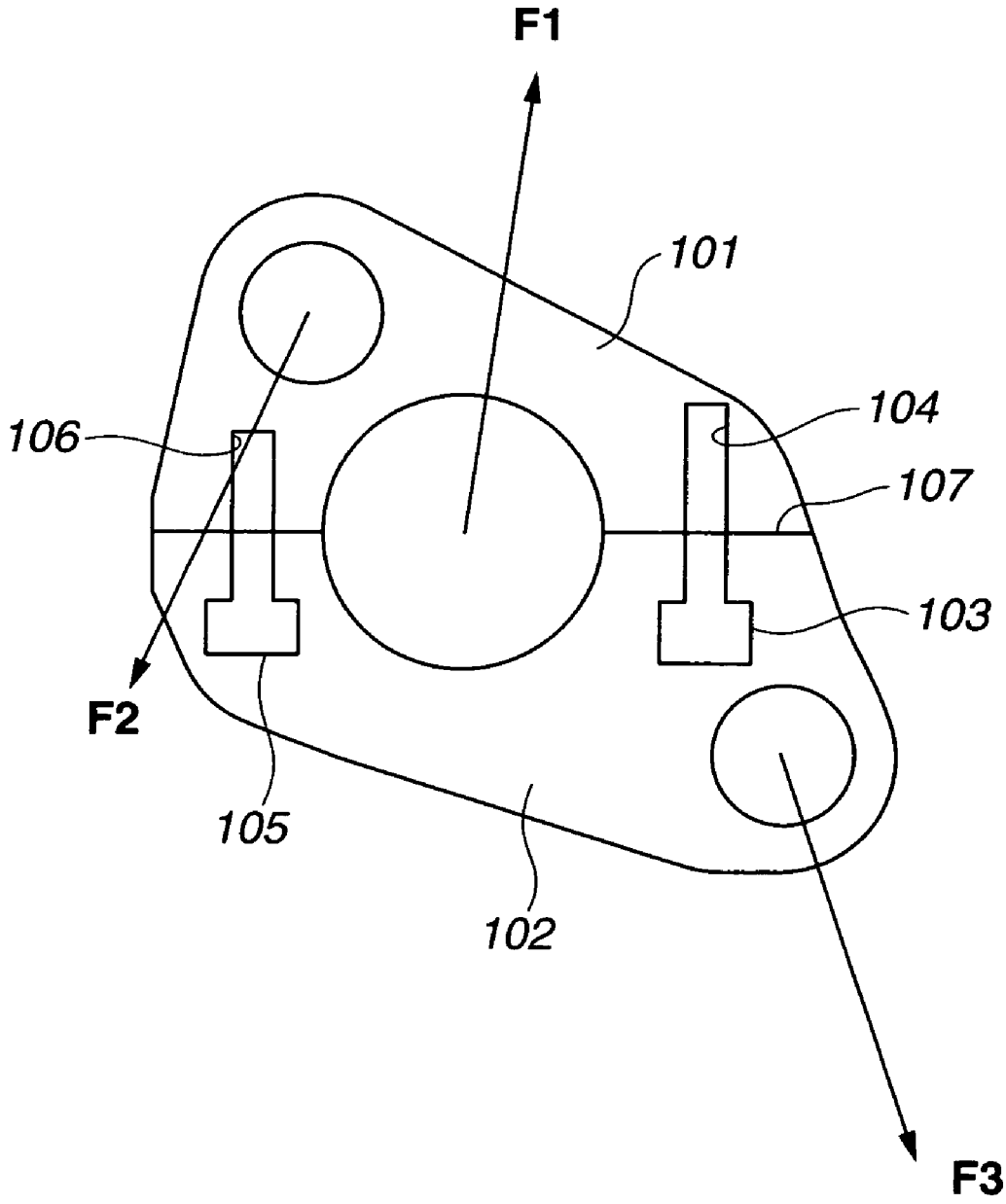
FIG. 9 is a view for illustrating a load acting to the lower link.
Figure 10:
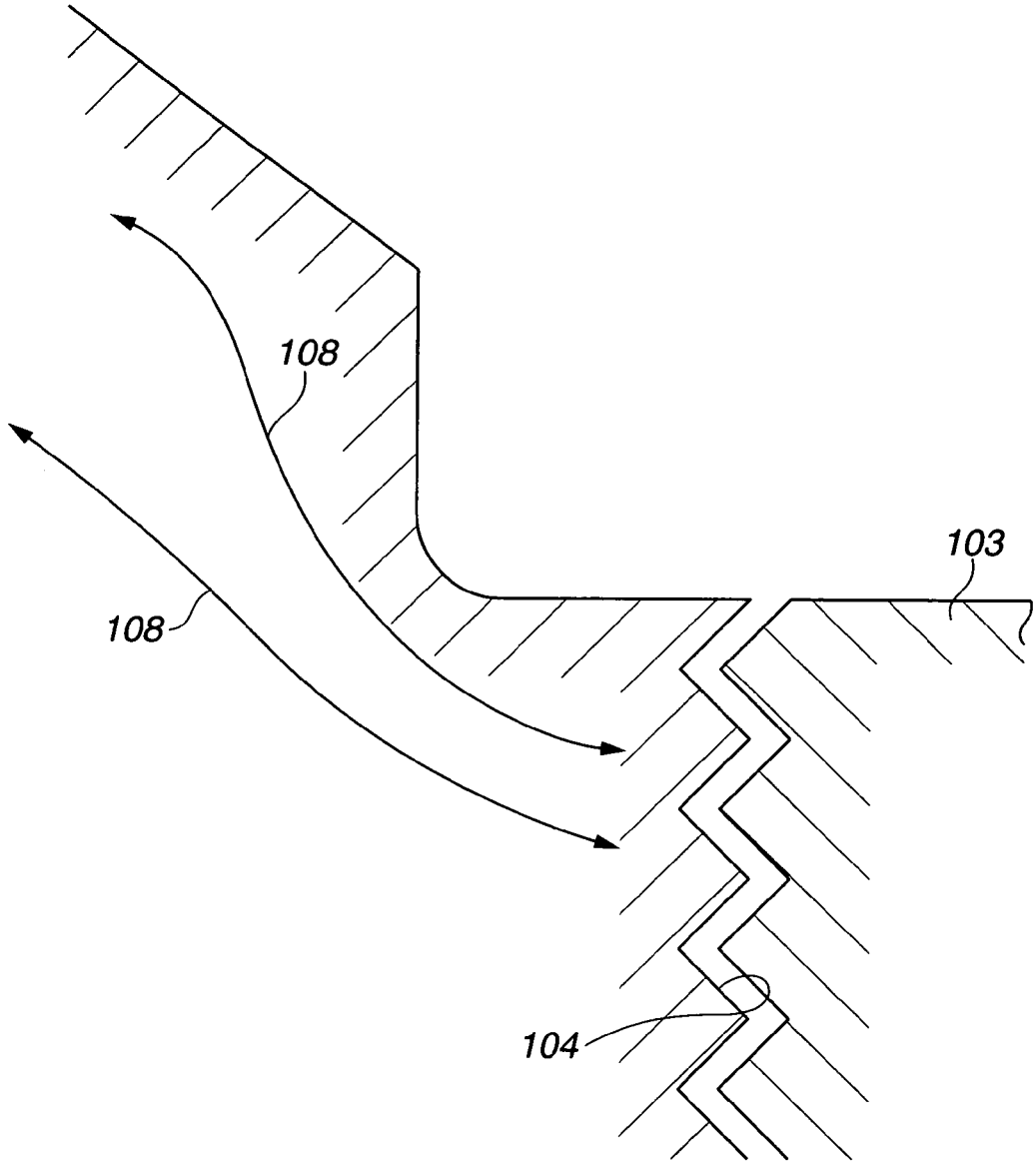
FIG. 10 is a view showing a stress transmitting path in a lower link of earlier technology.

FIG. 8 shows a lower link according to a fifth embodiment, and including a recessed portion 50 which is formed at the end portion on the crank pin's side of surface 45 (between crank pin bearing portion 21 and upper end opening 45), like the lower link of FIG. 3. In particular, in the section which passes through the center axis of bolt 33, and which extends along a plane perpendicular to the center axis of the crank pin, recessed portion 50 has a U-shaped section which has two parallel lines extends along each other, and an arc (semicircle) having a diameter of distance between the two lines. The two lines are inclined with respect to the center axis of bolt 33, and are away from the center axis of bolt 33 as the two lines extend from an open end of recessed portion 50 toward a bottom of recessed portion 50. Recessed portion 50 having this sectional shape is readily manufactured by tools having a cylindrical shape which is slightly inclined. Recessed portion 50 has thus inclined section, and accordingly the stress transmitting path is apart from the roots of internal thread 35 near the open end (upper end opening 35*a*).

In the apparatus according to the embodiments, the piston crank mechanism includes the upper link having the first end connected through the piston pin with the piston, and the second end connected through the upper pin to the lower link, and the control link having the first end swingably supported by the engine, and the second end connected through the control pin to the lower link. The lower link for the piston crank mechanism of the internal combustion engine includes the upper section including the upper pin boss portion arranged to hold the upper pin; the lower section including the control pin boss portion arranged to hold the control pin; and the crank pin bearing section disposed between the upper section and the lower section, and mounted on the crank pin of the crank shaft. The upper section and the lower section is coupled by at least two bolts disposed to sandwich the crank pin bearing section. One of the upper section and the lower section is formed with the bolt inserting hole. The other of the upper section and the lower section is formed with the internal thread portion including the open end. One of the bolts passes through the bolt inserting hole of the one of the upper section and the lower section, is screwed into the internal thread portion of the other of the upper section and the lower section, and includes the end bared from the open end of the internal thread portion which is formed in a surface perpendicular to the bolt center axis. The other of the upper section and the lower section includes the recessed portion formed in the surface to divert the stress transmitting path.

In the apparatus according to the embodiments of the present invention, the recessed portion is recessed in the direction of the bolt center axis, and the recessed portion has the axial depth which is larger than the pitch of the screw of the internal thread portion. The lower link further includes a hardened layer located on the surface of the lower link around the open end; and the recessed portion has the depth which is larger than the thickness of the hardened layer.

In this way, the recessed portion is provided adjacent to the open end of the internal thread, the transmitting path of the stress acting to the lower link is diverted outside the recessed portion among the upper pin boss portion, the crank pin bearing portion, and the control pin boss portion. Accordingly, it is possible to decrease the concentration of the stress to the roots of the internal thread near the open end, and to improve the durability and the reliability of the internal thread portion.

In the apparatus according to the embodiment of the present invention, the lower link further includes a pair of ribs each extending along the plane perpendicular to the crank pin center axis so as to sandwich the open end of the internal thread portion, and the surface is located at the bottom between the pair of the ribs. One of the upper pin boss portion and the control pin boss portion is bifurcated to be connected with the ribs.

In this way, the pair of the ribs are provided, and the stress (load) is transmitted through the ribs which has relatively higher rigidity (the ribs serve as the load transmitting portion because the ribs have a relatively higher rigidity.) Accordingly, it is possible to further decrease the stress in the internal thread portion with the effect that the recessed portion diverts the stress transmitting path.

In the apparatus according to the embodiments of the present invention, the recessed portion is located between each of the ribs and the open end. Accordingly, it is possible to decrease the transmission from the ribs.

In the apparatus according to the embodiments of the present invention, the recessed portion is located between the bolt center axis and the crank pin bearing section, in the section which passes through the bolt center axis, and which is perpendicular to the crank pin center axis. The open end is located between the recessed portion and the crank pin bearing section, in the section which passes through the bolt center axis, and which is perpendicular to the crank pin center axis.

In the apparatus according to the embodiments of the present invention, the recessed portion surrounds the open end.

In the apparatus according to the embodiments, the recessed portion has the U-shaped section in the section which passes through the bolt center axis, and which is perpendicular to the crank pin center axis; and the U-shaped section of the recessed portion has the corner on the bolt's side which has the radius larger than the radius of the corner on the crank pin's side. In this way, the radius of the corner on the bolt's side is large, and accordingly it is possible to prevent the concentration of the stress, and to decrease the input of the load to the internal thread portion.

In the apparatus according to the embodiments, the recessed portion has the U-shaped section, in the section which passes through the central axis of the bolt, and which is perpendicular to the crank pin center axis; and the U-shaped section of the recessed portion has two lines which are parallel with each other, and an arc which has the diameter which is the distance between the two lines. Thus-shaped recessed portion can be readily manufactured by the cylindrical tool.

In the apparatus according to the embodiments, the two lines of the U-shaped section of the recessed portion are inclined with respect to the bolt center axis, in a section which passes through the bolt center axis, and which is perpendicular to the crank center axis. The recessed portion with thus-shaped section is readily manufactured by the cylindrical tool which is slightly inclined. Accordingly, it is possible to separate the stress transmitting path from the bottomed portion of the internal thread near the open end.

In the apparatus according to the embodiment, it is possible to decrease the concentration of the stress to the open end of the internal thread portion engaged with the end of the bolt which tends to the source of the fatigue breakdown.

This application is based on a prior Japanese Patent Application No. 2005-365704. The entire contents of the Japanese Patent Application No. 2005-365704 with a filing date of Dec. 20, 2005 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A lower link for a piston crank mechanism of an internal combustion engine, the piston crank mechanism including an upper link having a first end connected through a piston pin with a piston, and a second end connected through an upper pin to the lower link, and a control link having a first end swingably supported by the engine and a second end connected through a control pin to the lower link, the lower link comprising:

an upper section including an upper pin boss portion arranged to hold the upper pin;

a lower section including a control pin boss portion arranged to hold the control pin; and a crank pin bearing section disposed between the upper section and the lower section, and mounted on a crank pin of a crank shaft;

the upper section and the lower section being coupled by at least two bolts disposed to sandwich the crank pin bearing section, one of the upper section and the lower section being formed with a bolt inserting hole, the other of the upper section and the lower section being formed with an internal thread portion including an open end, one of the at least two bolts passing through the bolt inserting hole of the one of the upper section and the lower section, being screwed into the internal thread portion of the other of the upper section and the lower section, and including an end bared from the open end of the internal thread portion which is formed in a surface perpendicular to a bolt center axis, and the other of the upper section and the lower section including a recessed portion formed in the surface to divert a stress transmitting path.

2. The lower link as claimed in claim 1, wherein the recessed portion is recessed in a direction of the bolt center axis, and the recessed portion has an axial depth which is larger than a pitch of a screw of the internal thread portion.

3. The lower link as claimed in claim 1, wherein the lower link further comprises a pair of ribs each extending along a plane perpendicular to a crank pin center axis so as to sandwich the open end of the internal thread portion, and the surface is located at a bottom between the pair of the ribs.

4. The lower link as claimed in claim 3, wherein one of the upper pin boss portion and the control pin boss portion is bifurcated to be connected with the ribs.

5. The lower link as claimed in claim 3, wherein the recessed portion is located between each of the ribs and the open end.

6. The lower link as claimed in claim 1, wherein the recessed portion is located between the bolt center axis and the crank pin bearing section, in a section which passes through the bolt center axis, and which is perpendicular to a crank pin center axis.

7. The lower link as claimed in claim 1, wherein the open end is located between the recessed portion and the crank pin bearing section, in a section which passes through the bolt center axis, and which is perpendicular to a crank pin center axis.

8. The lower link as claimed in claim 1, wherein the recessed portion surrounds the open end.

9. The lower link as claimed in claim 1, wherein the recessed portion has a U-shaped section in a section which passes through the bolt center axis, and which is perpendicular to a crank pin center axis; and the U-shaped section of the recessed portion has a corner on the bolt's side which has a radius larger than a radius of a corner on the crank pin's side.

10. The lower link as claimed in claim 1, wherein the recessed portion has a U-shaped section, in a section which passes through the central axis of the bolt, and which is perpendicular to a crank pin center axis; and the U-shaped section of the recessed portion has two lines which are parallel with each other, and an arc which has a diameter which is a distance between the two lines.

11. The lower link as claimed in claim 10, wherein the two lines of the U-shaped section of the recessed portion are inclined with respect to the bolt center axis, in a section which passes through the bolt center axis, and which is perpendicular to the crank center axis.

12. The lower link as claimed in claim 1, wherein the recessed portion is recessed in a direction of the bolt center axis; the lower link further comprises a hardened layer located on a surface of the lower link around the open end; and the recessed portion has a depth which is larger than a thickness of the hardened layer.

13. The lower link as claimed in claim 1, wherein the upper section is abutted on the lower section at a dividing surface passing through a center portion of the crank pin bearing section.

14. The lower link as claimed in claim 1, wherein the other of the upper section and the lower section includes two recessed portions; one of the two recessed portions is located between the bolt center axis and the crank pin bearing section, in a section which passes through the bolt center axis, and which is perpendicular to a crank pin center axis; and the open end is located between the two recessed portions.

15. The lower link as claimed in claim 1, wherein the internal thread portion is formed with two open ends.

16. The lower link as claimed in claim 1, wherein the bolt inserting hole is unthreaded, and wherein an axis of the bolt inserting hole is parallel to an axis of the internal thread portion.

17. The lower link as claimed in claim 1, wherein the one of the at least two bolts passing though the bolt inserting hole has a head, and wherein the head is positioned opposite the recessed portion with respect to the upper section and the lower section.

* * * * *